US005554311A

United States Patent [19]

Katafuchi et al.

[11] Patent Number: 5,554,311

[45] Date of Patent: Sep. 10, 1996

[54] LUBRICANT FOR REFRIGERATING MACHINE EMPLOYING REFRIGERANT COMPRISING HYDROFLUOROETHANE

[75] Inventors: Tadashi Katafuchi; Akira Nakamura, both of Ichihara, Japan

[73] Assignee: Idemitsu Kosan Co., Ltd., Tokyo, Japan

[21] Appl. No.: 443,457

[22] Filed: May 18, 1995

Related U.S. Application Data

[63] Continuation of Ser. No. 177,074, Jan. 3, 1994, abandoned, which is a continuation-in-part of Ser. No. 18,157, Jan. 16, 1993, abandoned.

[30] Foreign Application Priority Data

Feb. 18, 1992 [JP] Japan ..... 4-030529
Feb. 17, 1993 [JP] Japan ..... 5-027907

[51] Int. Cl.[6] ..... C09K 5/04; C10M 107/02; C10M 105/32

[52] U.S. Cl. ..... 252/68; 508/485; 252/67

[58] Field of Search ..... 252/68, 67, 56 R, 252/56 S

[56] References Cited

U.S. PATENT DOCUMENTS 5,295,357 3/1994 Kaneko ..... 62/84
5,431,835 7/1995 Katafuchi et al. ..... 252/68

FOREIGN PATENT DOCUMENTS 0415778 3/1991 European Pat. Off. .
0440069 8/1991 European Pat. Off. .
0470788 2/1992 European Pat. Off. .
62-292895 12/1987 Japan .

*Primary Examiner*—Christine Skane
*Attorney, Agent, or Firm*—Antonelli, Terry, Stout & Kraus

[57] ABSTRACT

A lubricant composition for compression-type refrigerating machines containing tetrafluoroethane or the like as a refrigerant and a lubricant comprising (A) 40 to 95% by weight of a synthetic oil composed of a poly-α-olefin and/or an ethylene/α-olefin copolymer or a mixture of an alkylbenzene and a poly-α-olefin and/or an ethylene/α-olefin copolymer and (B) 5 to 60% by weight of a fluidity improver composed of both or either of an ester compound and a triglyceride. The lubricant composition is excellent in the performance such as wear resistance, electrical insulating properties, hydrolytic stability, nonhygroscopicity, etc. and also in returnability of the lubricant composition. Thus, the lubricant is especially effective when used in automobile or household air conditioner, refrigerator, etc. having high industrial usefulness.

15 Claims, No Drawings

LUBRICANT FOR REFRIGERATING MACHINE EMPLOYING REFRIGERANT COMPRISING HYDROFLUOROETHANE

CROSS-REFERENCE TO RELATED APPLICATION

This application is a continuation application of Ser. No. 177,074, filed Jan. 3, 1994, now abandoned, which application is a continuation-in-part application of Ser. No. 018,157, filed Feb. 16, 1993 (now abandoned).

This is a continuation-in-part application of application Ser. No. 08/018,157, filed Feb. 16, 1993.

BACKGROUND OF THE INVENTION

1. Field of the Invention

The present invention relates to a lubricant for refrigerating machines employing a refrigerant comprising hydrofluorocarbon such as tetrafluoroethane. More particularly, it relates to a lubricant for refrigerating machines which is used along with substituted fluorohydrocarbon (hereinafter sometimes referred to as "flon compound") such as 1,1,1,2-tetrafluoroethane (R-134a). As such, the lubricant is excellent in the performance such as wear resistance, electrical insulating properties, hydrolytic stability, nonhygroscopicity and the like and further has excellent returnability of the lubricant in a refrigerating cycle (characteristics that the lubricant is inclined to return to a compressor after it is circulated in the refrigerating cycle).

2. Description of the Related Arts

Conventionally, in a compression-type refrigerating cycle comprising a compressor, a condenser, an expansion valve and an evaporator, a flon compound including a fluorinated hydrocarbon such as dichlorodifluoromethane (R-12) and chlorodifluoromethane (R-22) has been used as the refrigerant. Many kinds of lubricants compatible with them have been produced industrially available for use.

However, there have been misgivings that these flon compounds widely used as the refrigerant are liable to cause depletion of the ozone layer and environmental pollution after they are released into the open air. In an effort to prevent environmental pollution, fluorohydrocarbons (or chlorofluorohydrocarbons), for example 1,1,1,2-tetrafluoroethane (R-134a) and the like have been developed as a possible replacement in recent years. Until now there have been introduced into market many so-called substituted flon compounds with minimized danger of environmental pollution and capable of satisfying said required properties, for example 1,1,2,2-tetrafluoroethane (R-134) and the like, as well as R-134a.

These new substituted flon refrigerants are different from conventional flon refrigerants in characteristics. Thus, glycol compounds, ester compounds and the like have been proposed as the lubricant for use in combination with them (U.S. Pat. No. 4,755,316, Japanese Patent Applications Laid-Open No. 33193/1991, No. 200895/1991, No. 200896/1991, No. 20975/1992 and No. 4294/1992), and these patents are intended to dissolve substituted flon refrigerants and lubricants completely so as to provide good returnability of the lubricants.

In an attempt to circulate all over a refrigerating cycle a refrigerant and a lubricant in their completely dissolved state as envisaged by these patents, however,, said lubricant must be selected from only a very limited number of compounds acceptable to the chemical properties of substituted flon refrigerants such as R-134a. Accordingly, the selected lubricant is forced to sacrifice certain aspects of the important performance required as the lubricant.

In fact, polyalkylene glycol compounds and ester compounds thereof, both known as compatible with R-134a, have been found to have insufficient wear resistance, along with faulty electrical insulating properties. It has also been found that the polyalkylene glycol compounds are highly hygroscopic while the ester compounds thereof are unstable hydrolytically. Thus the demand for a solution in these problems has been raised in relevant industrial segments.

The present invention has been completed on the basis of a concept quite contrary to ordinary con,on knowledge as set forth above, in an effort to find the solution in the problems. As the result, it has been found that all these aspects of the performance can be unified by using a substance excellent in wear resistance, insulation resistance, and the like as the lubricant, compounding therewith a fluidity improver to improve the fluidity of the lubricant in the presence of a refrigerant (R134a and the like) and thus providing excellent returnability of the lubricant in a compression-type refrigerating cycle. It has thus been made possible that a lubricant combined even with a new refrigerant has all the required performance including excellent wear resistance, electrical insulating properties, hydrolytic stability and the like and further ensuring excellent returnability of the lubricant. The present invention has been accomplished based on this finding.

SUMMARY OF THE INVENTION

Therefore, an object of the present invention is to provide a lubricant for refrigerating machines employing a refrigerant comprising tetrafluoroethane or the like, which is excellent in the performance such as wear resistance, electrical insulating properties, hydrolytic stability, nonhygroscopicity and especially has excellent returnability of the lubricant. The lubricant can be used in combination with a substituted flon refrigerant in a compression-type refrigerating cycle without a hitch.

Another object of the present invention is to provide a lubricant for refrigerating machines employing a refrigerant comprising tetrafluoroethane or the like, which is especially effective when used in automobile or household air conditioners, refrigerators and the like, having high industrial usefulness.

The present invention provides a lubricant for refrigerating machines employing a refrigerant comprising tetrafluoroethane or the like which comprises as an essential component a base oil comprising (A) 40 to 95% by weight of a synthetic oil composed of at least one member selected from the group consisting of a poly-α-olefin and an ethylene/α-olefin copolymer or a mixture of an alkylbenzene and at least one member selected from the group consisting of a poly-α-olefin and an ethylene/α-olefin copolymer and (B) 5 to 60% by weight of a fluidity improver comprising both or either of an ester compound and a triglyceride.

The lubricant of the present invention can be suitably used in various refrigerating machines and ordinarily in a compression-type refrigerating cycle comprising a compressor, a condenser, an expansion valve and an evaporator.

DESCRIPTION OF PREFERRED EMBODIMENTS

As set forth above, the lubricant of the present invention comprises the components (A) and (B) as the essential components, and the synthetic oil constituting the component (A) is at least one member selected from the group consisting of a poly-α-olefin and an ethylene/α-olefin copolymer or a mixture of an alkylbenzene and at least one member selected from the group consisting of a poly-α-olefin and an ethylene/ α-olefin copolymer.

Various poly-α-olefins can be used and ordinarily are each a polymer of α-olefin having 8 to 14 carbon atoms and a kinematic viscosity of 10 to 350 cSt at 40° C. Preferred among them is a polymer of 1-dodecene, a polymer of 1-decene or a polymer of 1-octene, each having a kinematic viscosity of 10 to 350 cSt at 40° C. In addition, a hydrogenated poly-α-olefin is included in the scope of the invention. A lubricant containing a synthetic oil comprising such a poly-α-olefin has a lower viscosity at low temperatures in the presence of a tetrafluoroethane refrigerant, to provide better returnability of the lubricant.

The ethylene/α-olefin copolymer is available from a variety of species and is exemplified by a copolymer of ethylene and an α-olefin having 3 to 12 carbon atoms such as propylene, 1-butene, 1-hexene, 1-octene, 1-decene and 1-dodecene. Among the copolymers, ethylene/propylene copolymer is particularly preferable. In addition, a hydrogenated poly-α-olefin is included in the scope of the present invention. The copolymer has a kinematic viscosity of usually 5 to 500 cSt, preferably 10 to 350 cSt at 40° C. The content of the ethylene unit in the copolymer is not specifically limited, but is preferably in the range of 25 to 80 mol%. The method of polymerizing the monomer and comohomer is not specifically limited, but may be any of the conventional known methods.

The above-mentioned poly-α-olefin and ethylene/α-olefin copolymer may be mixed in an arbitrary mixing ratio without specific limitation.

Various alkylbenzenes can be used as well and ordinarily are each an alkylbenzene having a kinematic viscosity of 5 to 500 cSt, preferably 10 to 350 cSt at 40° C. Either soft or hard alkylbenzene can be used provided that it meets the above-mentioned condition.

The alkylbenzene is not used singly but in the form of its mixture with said poly-α-olefin and/or ethylene/α-olefin copolymer as the synthetic oil as the component (A) of the present invention. The mixing ratio of the poly-α-olefin and/or ethylene/α-olefin copolymer (hereinafter referred to simply as "olefinic polymer") to the alkylbenzene is appropriately selected according to circumstances and is not particularly limited. Preferably the mixture has a poly-α-olefin content of 5% or more by weight, more preferably 50 to 90% by weight, most preferably 5 to 80% by weight of the mixture when using an olefinic polymer having a kinematic viscosity of 50 cSt at 40° C. When the mixture of the olefinic polymer and the alkylbenzene is used as the synthetic oil as the component (A), the mixing stability between the olefinic polymer and the fluidity improver as the component (B) is improved.

On the other hand, the fluidity improver acts to improve the fluidity of a hydrocarbonic compound at low temperatures (those of evaporator) in the presence of a small amount of a substitute flon refrigerant such as R-134a, so as to provide better returnability of the lubricant in a refrigerating cycle. The kinematic viscosity of the fluidity improver is not particularly limited but ordinarily is 2 to 100 cSt, preferably 3 to 50 cSt at 40° C.

Typical examples of the fluidity improver include an ester compound, particularly an ester compound having at least 2 ester bonds. A variety of these ester compounds can be used and an appropriate ester compound may be selected from them according to the intended use. Preferred among them is a reaction product as set forth in any of (I) to (V) below:

(I) A reaction product of ① a polybasic carboxylic acid or its derivative, ② a polyhydric alcohol or its derivative and ③ a monobasic fatty acid or its derivative.

(II) A reaction product of ① a polybasic carboxylic acid or its derivative, ② a polyhydric alcohol or its derivative and ④ a monohydric aliphatic alcohol or its derivative.

(III) A reaction product of ② a polyhydric alcohol or its derivative and ③ a monobasic fatty acid or its derivative (preferably an equivalent reaction product).

(IV) A reaction product of ④ a monohydric aliphatic alcohol or its derivative and ① a polybasic carboxylic acid or its derivative.

(V) A reaction product of ① a polybasic carboxylic acid or its derivative and ② a polyhydric alcohol or its derivative.

Various polybasic carboxylic acids ① can be used herein, and their preferred examples include an aliphatic saturated dicarboxylic acid having 2 to 12 carbon atoms (oxalic acid, malonic acid, succinic acid, glutaric acid, adipic acid, pimelic acid, suberic acid, azelaic acid, sebacic acid, dodecanoic-2 acid and the like), an aliphatic unsaturated dicarboxylic acid having 4 to 14 carbon atoms (maleic acid, fumaric acid, alkenylsuccinic acid and the like) and an aromatic dicarboxylic acid having 8 carbon atoms (phthalic acid, isophthalic acid, terephthalic acid and the like), a dicarboxylic acid such as epoxide of epoxyhexahydrophthalic acid and a tribasic or higher carboxylic acid such as citric acid, trimellitic acid and pyromellitic acid. Examples of their derivative include monoester, diester, metal salt, anhydride, acid chloride and the like of these polybasic carboxylic acids.

Examples of the polyhydric alcohol ② include glycols (ethylene glycol; diethylene glycol; triethylene glycol; tetraethylene glycol; polyethylene glycol; propylene glycol; dipropylene glycol; polypropylene glycol; 1,2-butylene glycol; 1,3-butylene glycol; 1,4-butylene glycol; 2,3-butylene glycol; polybutylene glycol; 2-methyl-2,4-pentanediol; 2-ethyl-1,3-hexanediol and the like), glycerin, hindered alcohol (neopentyl glycol, trimethylolpropane, pentaerythritol, dipentaerythritol and the like), sorbitol and sorbitan. Examples of their derivative include acid chloride, metal salt and the like.

Furthermore, various monobasic fatty acids ③ (including primary, secondary and tertiary compounds) can be used herein, and a monobasic fatty acid containing an alkyl group having 1 to 20 carbon atoms, particularly a branched alkyl group having 3 to 18 carbon atoms, and more particularly a branched alkyl group having 4 to 12 carbon atoms is preferable because of their marked effect on improving the fluidity of the lubricant. Their specific examples include acetic acid; propionic acid; iso-propionic acid; butyric acid; iso-butyric acid; pivalic acid; n-valeric acid; iso-valeric acid; caproic acid; 2-ethylbutyric acid; n-caproic acid; 2-methylcaproic acid; n-heptylic acid; n-octanoic acid; 2-ethylhexanoic acid; 3,5,5-trimethylhexanoic acid; nonanoic acid; tert-nonanoic acid, dodecanoic acid; laurie acid and the like). Examples of their derivatives include ester, metal salt, acid chloride, anhydride and the like.

Various monohydric aliphatic alcohols or their derivatives ④ can be used herein, and a monohydric aliphatic alcohol or its derivative containing an alkyl group having 1 to 20 carbon atoms, particularly a branched alkyl group having 3 to 18 carbon atoms and more particularly a branched alkyl group having 4 to 12 carbon atoms is preferable because of their marked effect on improving the fluidity of the lubricant. Their specific examples include methyl alcohol, ethyl alcohol, n-propyl alcohol, isopropyl alcohol, n-butyl alcohol, isobutyl alcohol, sec-butyl alcohol, tert-butyl alcohol, n-amyl alcohol, isoamyl alcohol, tert-amyl alcohol, diethyl carbinol, n-hexyl alcohol, methylamyl alcohol, ethylbutyl alcohol, heptyl alcohol, methylamyl carbinol, dimethylpentyl alcohol, n-octyl alcohol, sec-octyl alcohol, 2-ethylhexyl alcohol, isooctyl alcohol, n-nonyl alcohol, diisobutyl carbinol, n-decyl alcohol, isodecyl alcohol and the like. Examples of their derivatives include chloride, metal salt and the like.

It is preferable that above-mentioned ester compound should have a predetermined kinematic viscosity and be a reaction product as set forth in any of (I) to (V) above. The reaction product (I) can be obtained by reacting the compounds as enumerated in ①, ② and ③ above. For the reaction product (I) every detail of its structure has not necessarily been brought to light. Ordinarily, however, the the reaction product (I) has a structure wherein 2 carboxyl groups of the polybasic carboxylic acid ① (in the case with a derivative thereof, groups derived from the carboxyl groups; the same shall apply hereunder) each react to be bonded with a hydroxyl group of the polyhydric alcohol ② (in the case with a derivative thereof, groups derived from the hydroxyl groups; the same shall apply hereunder) and further another hydroxyl group of this polyhydric alcohol ② reacts to be bonded with a carboxyl group of the monobasic fatty acid ③. Meanwhile, the rest of carboxyl groups of the polybasic carboxylic acid ① and the rest of hydroxyl groups of the polyhydric alcohol ② may remain as the carboxyl group and hydroxyl group respectively, as they are or react with other functional groups.

The reaction product (II) can be obtained by reacting the compounds as enumerated in ①, ② and ④ above. For this reaction product (II) every detail of its structure has not necessarily been brought to light. Ordinarily, however, the reaction product (II) has a structure wherein 2 hydroxyl groups of the polyhydric alcohol ② each react to be bonded with a carbohxyl group of the polybasic carboxylic acid ① and further the remaining carboxyl group of this polybasic carboxylic acid ① reacts to be bonded with a hydroxyl group of the monohydric aliphatic alcohol ④. Meanwhile, the rest of carboxyl groups of the polybasic carboxylic acid ① and the rest of hydroxyl groups of the polyhydric alcohol ② may remain as the carboxyl group and hydroxyl group respectively, as they are or react with other functional groups.

These synthetic oils (A) and fluidity improvers (B) are mixed in a ratio by weight of 40 to 95%, desirably 50 to 90%, particularly desirably 60 to 90%, of (A) to 5 to 60%, desirably 10 to 50%, particularly desirably 10 to 40%, respectively of (B).

The fluidity of the lubricant is undesirably not improved when less than 5% by weight of the fluidity improver is used, resulting in insufficient returnability of the lubricant. When more than 60% by weight of the fluidity improver is used, wear resistance is undesirably lowered, accompanied by the degradation of the fundamental performance required of refrigerating machine lubricant including decrease in insulation resistance, worsening of hydrolytic stability, increase in hygroscopicity and the like.

As set forth above, the lubricant of the present invention comprises the synthetic oil (A) and the fluidity improver (B) as the essential component, but various additives can be incorporated therein as the need arises. Examples of the additive include an anti-wear additive such as phosphoric acid ester and phosphorous acid ester, an antioxidant, a chlorine scavenger, a metal deactivator, a defoaming agent, a detergent-dispersant, a viscosity index improver:, a rust preventive, a corrosion inhibitor and the like.

There are available a variety of refrigerants comprising flon compounds (substituted fluorohydrocarbon-based refrigerants) to be used in refrigerating machines in which a lubricant of the present invention is employed. Examples of such refrigerants include 1,1,1,2-tetrafluoroethane (R-134a); 1,1,2,2-tetrafluoroethane (R-134); 1,1-difluoroethane (R-152a); pentafluoroethane (R-125); trifluoromethane (R-23); and difluoromethane (R-32); 1,1,1-trifluoroethane (R-143a); and a mixed refrigerant such as a mixture of R-134a and R-125; R-134a and R-32; R-134a, R-125a and R- 32; R-143a and R-125; or R-143a, R-125 and R-134a.

As set forth above, the lubricant for refrigerating machines employing a refrigerant comprising tetrafluoroethane, as claimed herein, is excellent in the performance such as wear resistance, electrical insulating properties, hydrolytic stability, nonhygroscopicity and the like and especially has excellent returnability of the lubricant. The lubricant can be used along with a substitute flon refrigerant in a compression type refrigerating cycle without a hitch.

Thus, the lubricant of the present invention is especially effective when used in automobile or household air conditioner, refrigerator and the like, having high industrial usefulness.

The present invention will now be described in greater detail below with reference to non-limitative examples and comparative examples.

EXAMPLES 1 TO 9 AND COMPARATIVE EXAMPLE 1 to 3

The synthetic oils and the fluidity improvers were mixed as shown in Table 1 to prepare the lubricants for use in the following tests. The results thereof are given in Table 2.

TABLE 1

| | Mixing Composition | | | |
|---|---|---|---|---|
| | Synthetic Oil | | Fluidity Improver | |
| | Compound | Wt % | Compound | Wt % |
| Example 1 | Poly-α-olefinI*[1] | 80 | Ester A*[4] | 20 |
| Example 2 | Poly-α-olefinI*[1] | 60 | Ester A*[4] | 40 |
| Example 3 | Poly-α-olefinI*[1] | 70 | Ester B*[5] | 30 |
| Example 4 | Poly-α-olefinI*[1] | 70 | Triglyceride*[6] | 30 |
| Example 5 | Poly-α-olefinII*[2] | 60 | Ester A*[4] | 40 |
| Example 6 | Poly-α-olefinI*[1]<br>Alkylbenzene*[3] | 50<br>30 | Ester A*[4] | 20 |
| Example 7 | Poly-α-olefinI*[1]<br>Alkylbenzene*[3] | 40<br>20 | Ester A*[4] | 40 |
| Example 8 | Poly-α-olefinI*[1]<br>Alkylbenzene*[3] | 50<br>30 | Ester B*[5] | 20 |
| Example 9 | Ethylene/ propylene copolymer | 80 | Ester A*[4] | 20 |
| Comparative Example 1 | Alkylbenzene*[3] | 80 | Ester B*[5] | 20 |
| Comparative Example 2 | Poly-α-olefinI*[1] | 30 | Ester A*[4] | 70 |
| Comparative Example 3 | Poly-α-olefinI*[1]<br>Alkylbenzene*[3] | 10<br>10 | Ester B*[5] | 80 |

TABLE 2

| | Performance | |
|---|---|---|
| | Fluidity at low temperatures (relative value) | Wear resistance |
| Example 1 | 20 | ○ |
| Example 2 | 20 | ○ |
| Example 3 | 18 | ○ |
| Example 4 | 16 | ○ |
| Example 5 | 22 | ○ |
| Example 6 | 30 | ○ |
| Example 7 | 25 | ○ |
| Example 8 | 40 | ○ |
| Example 9 | 20 | ○ |
| Comparative Example 1 | 100 | ○ |
| Comparative Example 2 | 20 | X |
| Comparative Example 3 | 20 | X |

| | Insulation resistivity (Ω · cm) | Hydrolysis | Hygroscopicity |
|---|---|---|---|
| Example 1 | $6.8 \times 10^{14}$ | ○ | ○ |
| Example 2 | $8.2 \times 10^{13}$ | Δ | ○ |
| Example 3 | $2.2 \times 10^{14}$ | ○ | ○ |
| Example 4 | $8.8 \times 10^{13}$ | ○ | ○ |
| Example 5 | $8.0 \times 10^{13}$ | Δ | ○ |
| Example 6 | $3.2 \times 10^{14}$ | ○ | ○ |
| Example 7 | $7.2 \times 10^{13}$ | ○ | ○ |
| Example 8 | $1.2 \times 10^{13}$ | ○ | ○ |
| Example 9 | $7.0 \times 10^{14}$ | ○ | ○ |
| Comparative Example 1 | $3.0 \times 10^{14}$ | ○ | ○ |
| Comparative Example 2 | $1.5 \times 10^{13}$ | X | Δ |
| Comparative Example 3 | $1.2 \times 10^{13}$ | X | Δ |

All the lubricants used were mixed with 0.5% by weight of an anti-wear additive (phosphoric acid ester). The notes in the tables will be supplemented below:

*1: A polymer of 1-decene (a kinematic viscosity of 32 cSt at 40° C.)

*2: A polymer of 1-decene (a kinematic viscosity of 46 cSt at 40° C.)

*3: Soft alkylbenzene (a kinematic viscosity of 38 cSt at 40° C.)

*4: An ester of $C_7$ fatty acid and pentaerythritol (a kinematic viscosity of 30 cSt at 40° C.)

*5: An ester of $C_7$ fatty acid and trimethylolpropane (a kinematic viscosity of 14 cSt at 40° C.)

*6: 2-ethylhexyltriglyceride (a kinematic viscosity of 16 cSt at 40° C.)

The lubricants were evaluated by determining each aspect of their performance thereof in accordance with the following test method:

Evaluation of the performance (1) Fluidity of the lubricants at low temperatures A lubricant mixed with 10% of R-134a was collected into a pressure glass tube having a diameter of 8 mm, a steel ball of 3/16 in diameter was introduced therein, and the pressure glass tube was sealed.

After the pressure glass tube was retained at −45° C., the steel ball was caused to fall to determine the time (second) required until the steel ball reached a point 10 cm to 5 cm above the bottom of the tube. The result thereof is given in terms of a relative value.

(2) Wear resistance

The wear resistance was tested under the following conditions by using a Falex friction testing machine.

R-134a was blown at a rate of 5 liter/hr, and a test piece was subjected to wear for 60 minutes under a load of 300 lbs and at 1,000 rpm. The test pieces such as block and pin were made of a standard material in accordance with ASTM D-3233.

Standard of evaluation (amount of wear)

○: Less than 6.0 mg

Δ: 6.0 mg or more to 15 mg or less

×: More than 15 mg (3) Electrical insulating properties

The electrical insulting properties was evaluated mutatis mutandis according to JIB C-2101 to determine the volume resistivity (room temperature ).

(4 ) Hydrolytic stability 100 g of a lubricant, 10 g of R-134a, 5 ml of water and iron and copper catalysts were placed in a pressure container having a capacity of 300 cc. Then, the container was sealed and retained at 100° C. for 5 days and thereafter the rate of a rise of the total acid number was determined.

Standard of evaluation

○: Less than 0.01 mgKOH/g

Δ: 0.01 mgKOH/g or more to 0.1 mgKOH/g or less

×: More than 0.1 mgKOH/g (5) Hygroscopicity 10 g of a test sample was placed in a 50 cc glass container having a diameter of 30 mm. The glass container was introduced into a thermostat-humidistat and allowed to stand for 5 days at a temperature of 25° C. and under a humidity of 85%, and then the water content in the test sample was determined.

Standard of evaluation

○: less than 0.3%

Δ: 0.03% or more to 0.1% or less

×: More than 0.1%

EXAMPLES 10 to 12

The lubricant, that is, the mixture of the synthetic oil and fluidity improver which lubricant is the same as that in Example 6 was tested in accordance with the testing procedure in Examples 1 to 9 and Comparative Examples 1 to 3 except that any of the refrigerants R-125, a mixture of R-134a and R-32 (70:30 by volume) and a mixture of R-143a and R-125 (50:50 by volume) was used in place of R-134a. The results thereof are given in Table 3.

TABLE 3

| | | Performance | | | | |
|---|---|---|---|---|---|---|
| | Refrigerant | Fluidity at low temperatures (relative value) | Wear resistance | Insulation resistivity (Ω · cm) | Hydrolysis | Hygro-scopicity |
| Example 10 | R-125 | 27 | ○ | $3.2 \times 10^{14}$ | ○ | ○ |
| Example 11 | R-134a + R-32 (70:30) | 30 | ○ | $3.2 \times 10^{14}$ | ○ | ○ |
| Example 12 | R-143a + R-125 (50:50) | 29 | ○ | $3.2 \times 10^{14}$ | ○ | ○ |

What is claimed is:

1. A lubricant composition for a compression-type refrigerating machine, said composition comprising a refrigerant selected from the group consisting of 1,1,1,2-tetrafluoroethane (R-134a), 1,1,2,2-tetrafluoroethane (R-134), pentafluoroethane (R-125), difluoromethane (R-32), and 1,1,1-trifluoroethane (R-143a) and a lubricant comprising (A) 60 to 90% by weight of a synthetic oil composed of (A-1) at least one member selected from the group consisting of a poly-α-olefin and ethylene/α-olefin copolymer or (A-2) a mixture of an alkylbenzene and at least one member selected from the group consisting of a poly-α-olefin and an ethylene/α-olefin copolymer, said poly-α-olefin being a polymer of an α-olefin having 8 to 14 carbon atoms and a kinematic viscosity of 10 to 350 cSt at 40° C., and (B) 10 to 40% by weight of a fluidity improver composed of at least one member selected from the group consisting of an ester compound and a triglyceride; said ester compound being selected from the group consisting of:

(I) a reaction product of a polybasic carboxylic acid or a derivative thereof, a polyhydric alcohol or a derivative thereof and a monobasic fatty acid or a derivative thereof, (II) a reaction product of a polybasic carboxylic acid or a derivative thereof, a polyhydric alcohol or a derivative thereof and a monohydric aliphatic alcohol or a derivative thereof, (III) a reaction product of a polyhydric alcohol or a derivative thereof and a monobasic fatty acid or a derivative thereof, (IV) a reaction product of a monohydric aliphatic alcohol or a derivative thereof and a polybasic carboxylic acid or a derivative thereof, or (v) a reaction product of a polybasic carboxylic acid or a derivative thereof and a polyhydric alcohol or a derivative thereof.

2. The lubricant composition according to claim 1, wherein said polymer of an α-olefin is a polymer of 1-dodecene, 1-decene or 1-octene, each having a kinematic viscosity of 10 to 350 cSt at 40° C.

3. The lubricant composition according to claim 1, wherein said ethylene/α-olefin copolymer is a copolymer of ethylene and an α-olefin selected from the group consisting of propylene, 1-butene, 1-hexene, 1-octene, 1-decene and 1-dodecene.

4. The lubricant composition according to claim 1, wherein said alkylbenzene is selected from a soft alkylbenzene or a hard alkylbenzene, each having a kinematic viscosity of 10 to 350 cSt at 40° C.

5. The lubricant composition according to claim 1, wherein said mixture of the alkylbenzene and at least one member selected from the group consisting of a poly-α-olefin and an ethylene/α-olefin copolymer has an olefinic polymer content of 5 to 90% by weight of the mixture.

6. The lubricant composition according to claim 1, wherein said fluidity improver (B) has a kinematic viscosity of 3 to 50 cSt at 40° C.

7. The lubricant composition according to claim 1, wherein said ester compound has 2 or more ester bonds.

8. The lubricant composition according to claim 1, wherein said refrigerant is R-134a.

9. The lubricant composition according to claim 1, wherein said refrigerant is R-125.

10. The lubricant composition according to claim 1, wherein said refrigerant is R-143a.

11. The lubricant composition according to claim 1, wherein said refrigerant is a mixture of R-134a and R-125.

12. The lubricant composition according to claim 1, wherein said refrigerant is a mixture of R-134a and R-32.

13. The lubricant composition according to claim 1, wherein said refrigerant is a mixture of R-134a, R- 125 and R-32.

14. The lubricant composition according to claim 1, wherein said refrigerant is a mixture of R-143a and R-125.

15. The lubricant composition according to claim 1, wherein said refrigerant is a mixture of R-143a, R-125 and R-134a.

* * * * *